United States Patent [19]

Royer

[11] Patent Number: 4,514,167

[45] Date of Patent: Apr. 30, 1985

[54] OVEN HEATING SYSTEM

[75] Inventor: Wayne H. Royer, Felton, Pa.

[73] Assignee: Santrade Ltd., Lucerne, Switzerland

[21] Appl. No.: 540,924

[22] Filed: Oct. 11, 1983

[51] Int. Cl.[3] ..... F27D 3/00; F27D 7/00; F27B 9/22; F27B 9/00

[52] U.S. Cl. ..... 432/11; 99/443 C; 99/447; 432/21; 432/140; 432/146; 432/152

[58] Field of Search ..... 432/11, 21, 140, 146, 432/152; 99/443 C, 447; 426/523

[56] References Cited

U.S. PATENT DOCUMENTS

| | | | |
|---|---|---|---|
| 1,844,150 | 2/1932 | Fiske | 432/152 |
| 2,033,261 | 3/1936 | Stewart | 432/146 |
| 4,012,190 | 3/1977 | Dicks et al. | 432/136 |

*Primary Examiner*—John J. Camby

*Attorney, Agent, or Firm*—Burns, Doane, Swecker & Mathis

[57] ABSTRACT

A conveyor is driven in a helical endless fashion within a horizontally annular baking chamber while carrying products to be baked. The air within the chamber is heated by means of burners disposed beneath the conveyor and in non-parallel relationship thereto. Heated air is drawn through an air permeable cover across the top of the chamber and into an upper air space thereabove. The air is circulated from that upper air space to a lower air space located beneath the chamber. The air is then circulated into the chamber through an air permeable floor disposed across the bottom of the chamber. The permeability of the cover and floor varies in order to assure a uniform passage of heated air therethrough.

28 Claims, 6 Drawing Figures

OVEN HEATING SYSTEM

BACKGROUND AND OBJECTS OF THE INVENTION

The present invention relates to ovens and, in particular, to commercial ovens in which dough products are baked.

Commercial baking ovens for dough products may comprise a baking chamber within which an endless conveyor belt travels. The conveyor belt may comprise a chain and a series of carriers connected to the chain for travel in a helical path within the chamber. The chamber is heated to a desired baking temperature and the conveyor belt carries pans of dough through the heated chamber at a prescribed rate of speed suitable for a proper baking of the dough. Heating of the chamber may be accomplished by positioning gas burners beneath the vertically spaced runs of the conveyor, the burners being oriented parallel to the path of travel of the conveyor belt.

It would be desirable to establish a uniform baking temperature within the chamber to achieve an ideal baking action. In practice, however, such temperature uniformity throughout the chamber has been difficult to attain, due in part to the normal upward convection of heat within the chamber. While the problem can be alleviated to some extent by adjusting the heat output of the various burners, different temperatures may still occur throughout the height of the chamber. As a result, it is difficult to achieve an ideal and uniform baking performance.

It is, therefore, an object of the present invention to minimize or obviate problems of the type discussed above.

A further object is to improve the baking performance and achieve more uniform results.

Another object is to achieve a more uniform temperature within a baking chamber.

A further object is to establish a positive air flow and a more uniform redistribution of heated air within the chamber.

SUMMARY OF THE INVENTION

These objects are achieved by the present invention which relates to a baking oven which comprises an enclosure containing therein a horizontally annular baking chamber. A conveyor is arranged to travel in an endless helical path through the baking chamber while carrying a product to be baked. Heaters are located beneath at least some of the runs of the conveyor for heating the air within the baking chamber. An air distributing mechanism comprises a conduit for conducting air from an upper portion of the baking chamber to a lower portion of the baking chamber, and an air circulating member for transferring air through the conduit from the upper portion of the baking chamber to the lower portion of the baking chamber to attain a more uniform air temperature within the baking chamber.

Preferably, a floor is disposed beneath the baking chamber. The conduit delivers air to a lower air space disposed beneath the floor. The floor is air permeable such that the air travels through the floor and into the baking chamber. The degree of air permeability of the floor increases in a direction away from an air inlet where the conduit means delivers air to the lower air space.

Preferably, a cover overlies the baking chamber. The conduit is arranged to receive air from an upper air space above the cover. The cover is air permeable to permit the upward floor of air therethrough from the baking chamber. The degree of air permeability of the cover increases in a direction away from an air outlet where the conduit receives air from the upper air space.

Preferably, the conduit is disposed midway along the length of the enclosure. The heaters preferably comprise pairs of gas burners disposed beneath respective runs of the conveyor. The burners of each pair are parallel relative to one another and non-parallel relative to the travel path of the associated run of the conveyor.

The present invention also relates to the method of baking as described above.

THE DRAWINGS

The objects and advantages of the present invention will become apparent from the following detailed description of a preferred embodiment thereof, in connection with the accompanying drawings, in which like numerals designate like elements, and in which.

DETAILED DESCRIPTION OF A PREFERED EMBODIMENT OF THE INVENTION

Figure 1:
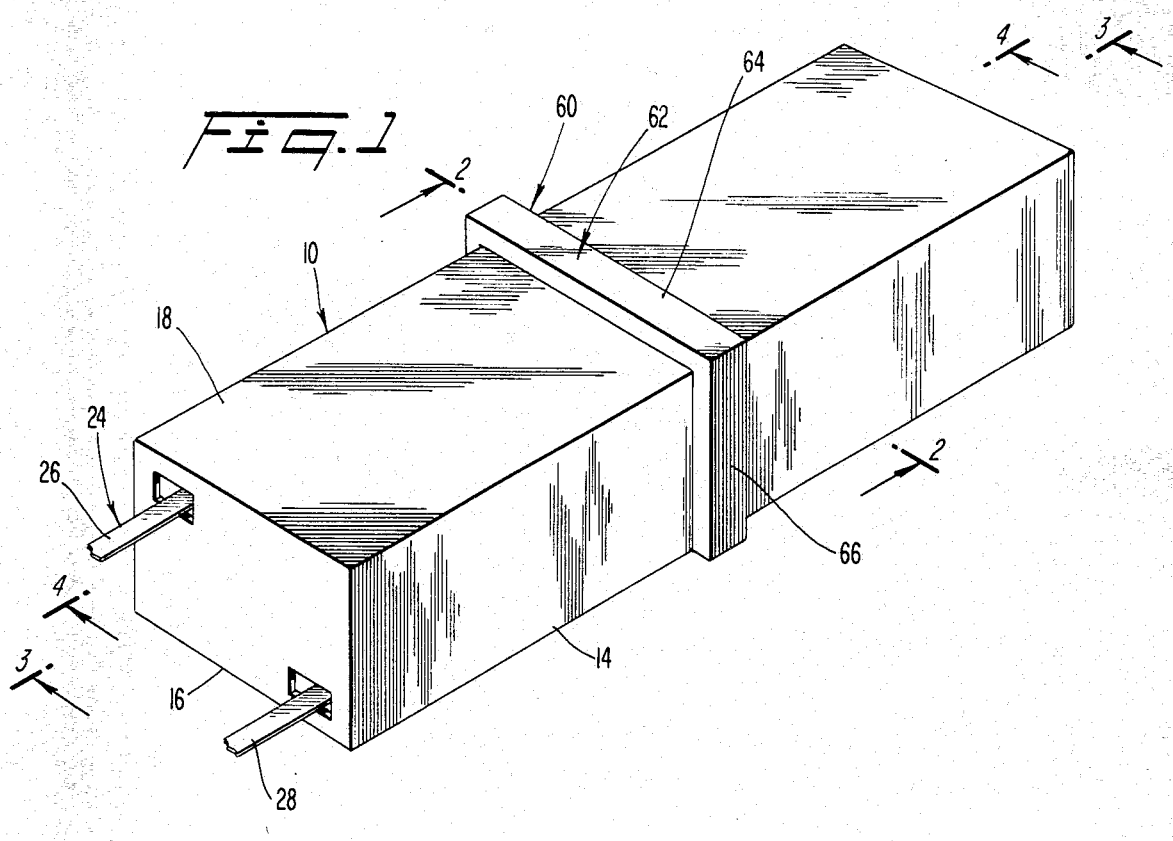
FIG. 1 is a perspective view of a baking oven in which the present invention can be utilized.

A commercial baking oven 10 according to the present invention comprises an enclosure 12 having long side walls 14, shorter end walls 16, a roof 18, and a base 20.

Figure 2:
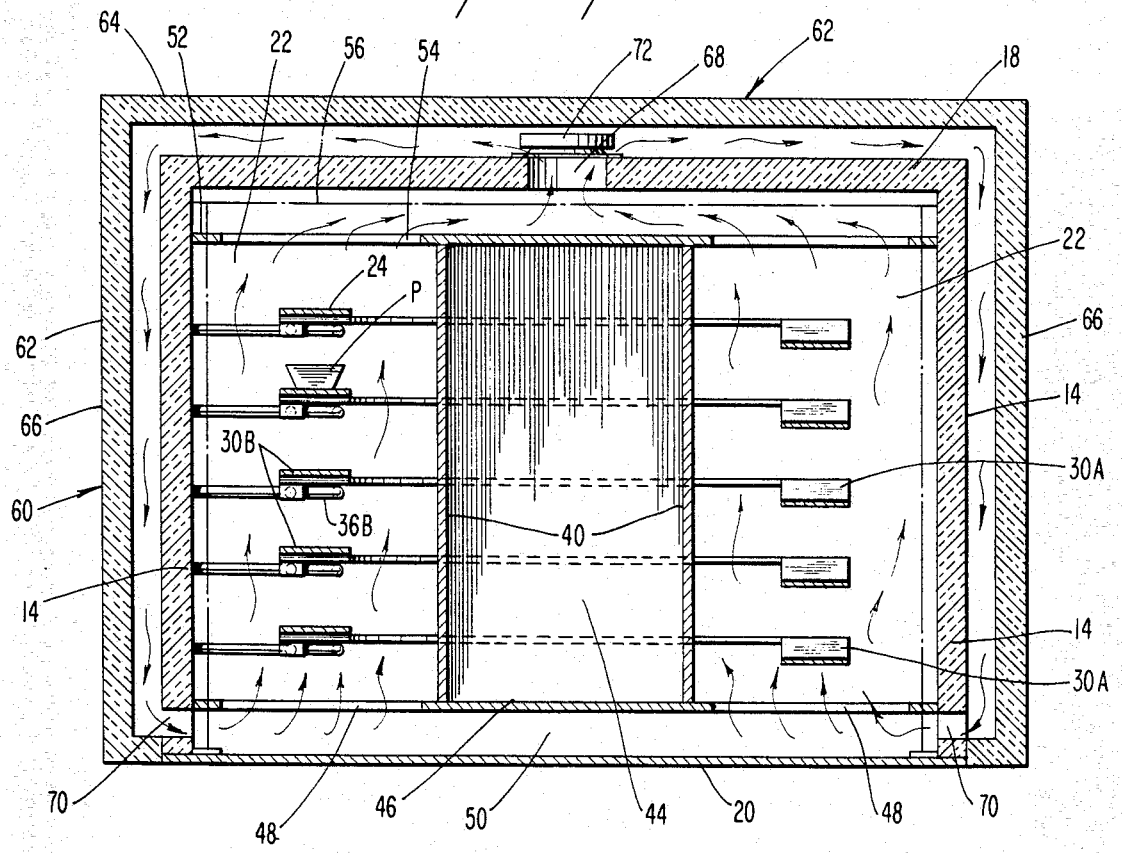
FIG. 2 is a vertical cross-sectional view taken through the center of the enclosure and air circulation duct along line 2—2 in FIG. 1.
Figure 3:
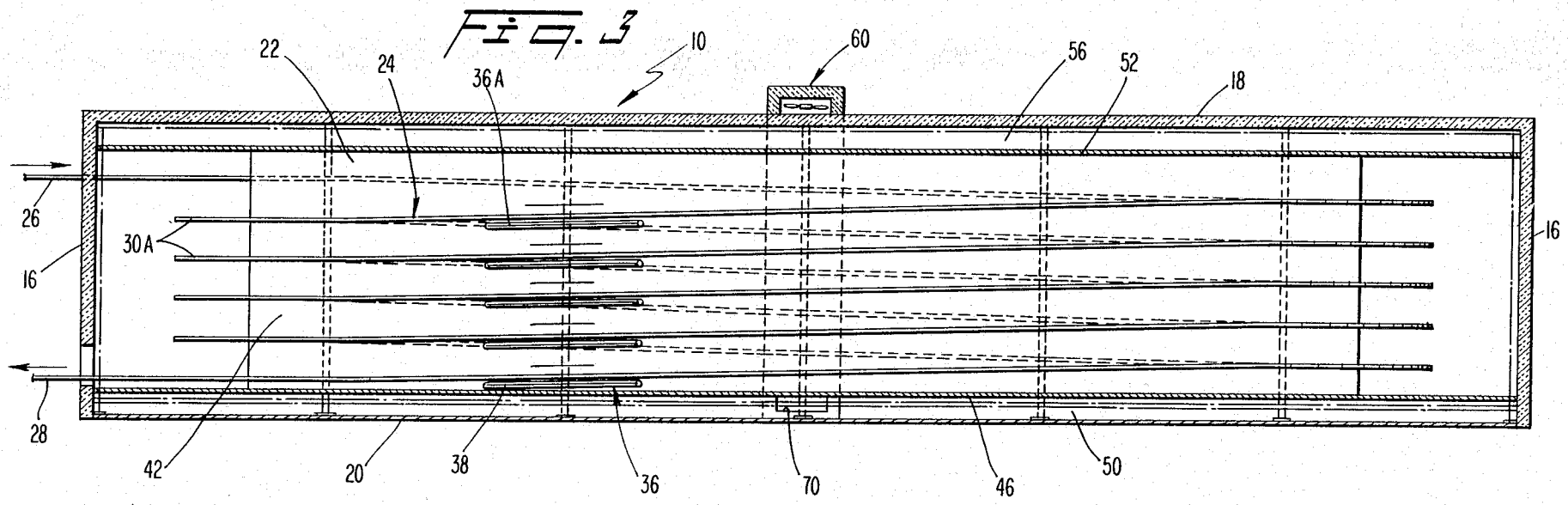
FIG. 3 is a vertical longitudinal sectional view taken through the enclosure along line 3—3 in FIG. 1.
Figure 4:
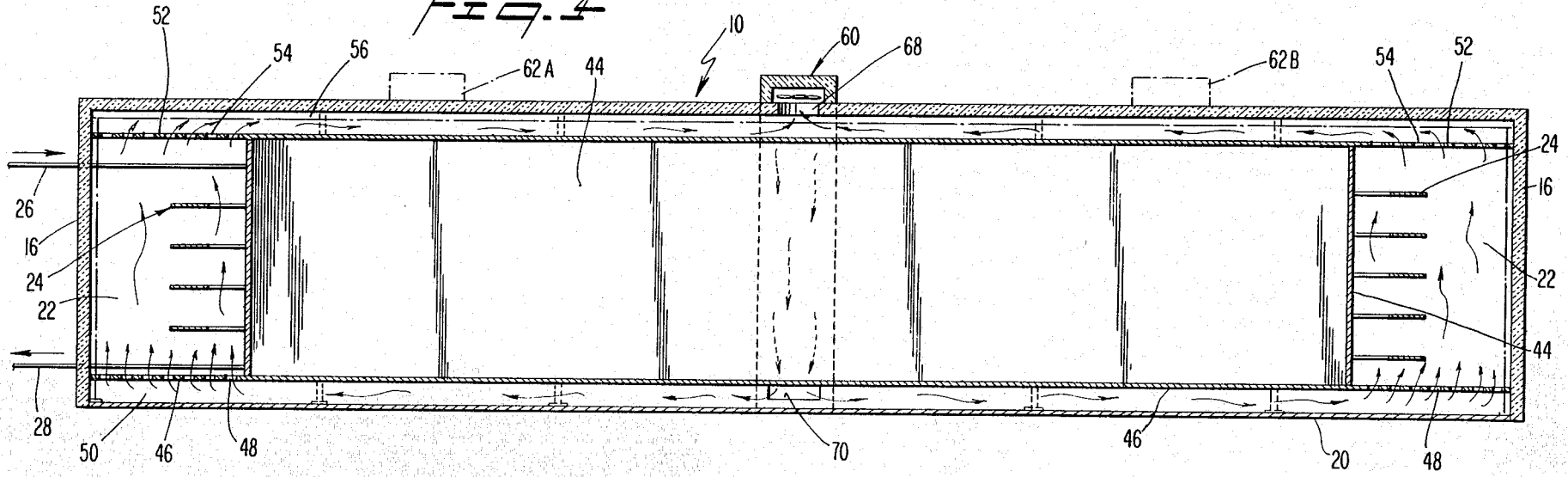
FIG. 4 is a vertical longitudinal sectional view taken through the center of the enclosure along line 4—4 of FIG. 1.

The enclosure thus encloses a baking chamber 22 within which a conveyor 24 is arranged to travel in a helical path. The conveyor includes portions 26, 28 extending out of the enclosure to provide for the reception and removal of a product. The product may comprise a dough product such as bread or rolls, for example, which is placed within steel pans P (FIG. 2).

The conveyor can be of any suitable type and may include a driven chain and a series of air permeable grids carried by the chain. The pans sit upon the grids, and the chain is mounted for movement along an endless track. The track is supported by any suitable skeletal framework (not depicted) within the chamber. Any suitable drive mechanism can be provided for driving the conveyor 24.

As the conveyor 24 travels helically within the chamber 22, it defines a plurality of relative straight side runs 30A on one side of the chamber, a plurality of straight side runs 30B on the opposite side of the chamber, and a plurality of curved end runs 32 which interconnect the side runs 30A, 30B.

Figure 5:
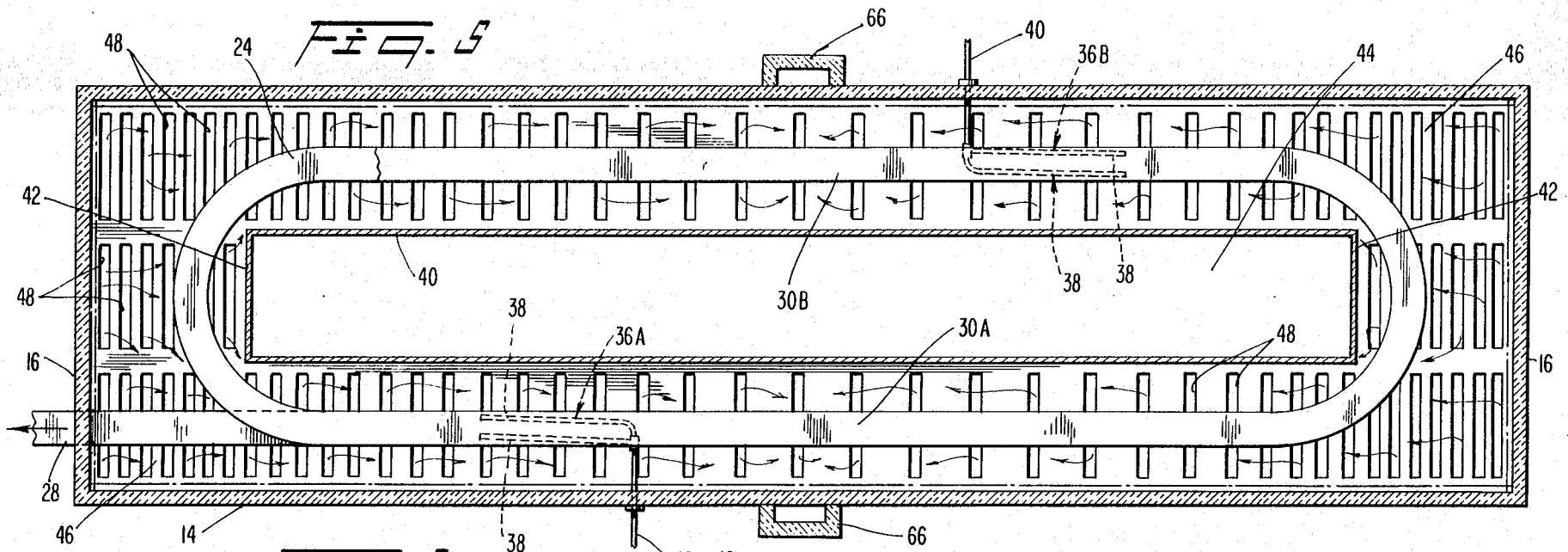
FIG. 5 is a horizontal longitudinal sectional view taken through the center of the oven enclosure and depicting the floor which underlies the baking chamber.
Figure 6:
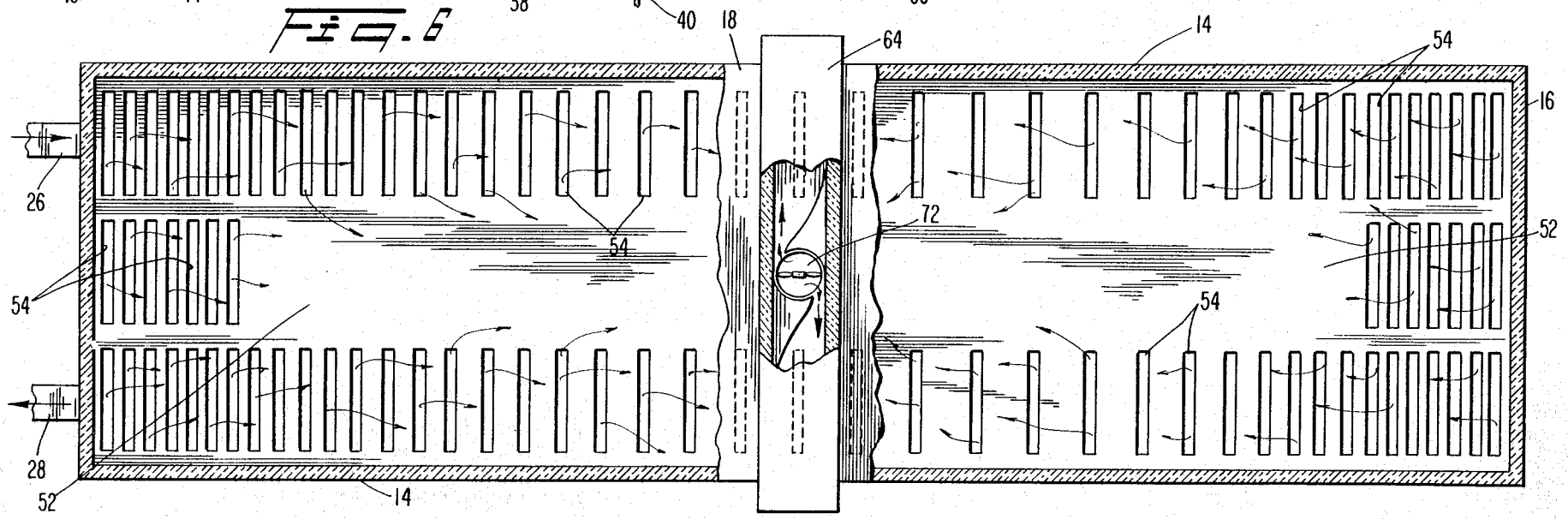
FIG. 6 is a plan view of the oven enclosure with portions of the roof thereof broken away to depict the cover which overlies the baking chamber.

Situated beneath the side runs 30A and 30B of the conveyor are heating assemblies 36A, 36B each in the form of a pair of gas burners 38 (FIG. 5). The gas burners are of a conventional design and have gas inlet ducts 40 which supply a suitable gaseous fuel. The burners 38 are laterally spaced beneath the conveyor and are parallel to each other and non-parallel relative to the path of travel of the associated conveyor run. That is, as viewed from above, each burner makes an angle of from $1\frac{1}{2}$ to $2\frac{1}{4}$ degrees relative to the direction of travel of the conveyor run. This angling is highly significant because it distributes the heat laterally across the pans as the pans travel thereover and thereunder. Thus, the heat is not concentrated along a line of the pan as would be the case if the burner was parallel to the direction of pan travel. Desirably, the burners are located closer to a lower end of the respective straight conveyor run 30A or 30B than to the upper end thereof.

Disposed within the enclosure are upright side partition walls 40 and upright end partition walls 42 extending internally of the path of travel of the conveyor 24. The partition walls 40, 42, together with the side and end walls 14, 16 of the enclosure, define the annular baking chamber 22. The partition walls 40, 42 themselves define a center access space 44. The partition walls 40, 42 may include doors to provide access to the baking chamber 22.

Disposed above the base 20 of the enclosure is a horizontal floor 46 upon which the conveyor support framework may rest. The floor 46 preferably extends completely across the enclosure and defines the lower wall of the baking chamber. That portion of the floor 46 located beneath the baking chamber is preferably air permeable in that it contains a series of slot-type apertures 48 which communicate the baking chamber with an air space 50 disposed beneath the floor 46. The portion of the floor extending beneath the access space 44 is non-air permeable. The size of the slots 48 are exaggerated in the drawings for clarity.

Extending across the top of the baking chamber 22 is a cover or ceiling 52 which is spaced below the roof 18. That portion of the cover 52 which overlies the baking chamber 22 is air permeable in that it contains a series of slot-type apertures 54 communicating the conveyor space within an air space 56 located above the cover 52. That portion of the cover 52 which overlies the access space 44 is non-air permeable.

An air distributing mechanism 60 is provided which continually circulates heated air from the upper air space 56 to the lower air space 50 and upwardly through the baking chamber 22 in order to enhance the uniformity of air temperature within the baking chamber 22. The air distributing mechanism 60 comprises a duct 62 disposed midway along the side 14 or lengthwise dimension of the enclosure 10.

The duct 62 includes a horizontal portion 64 extending along the roof 18 parallel to the end 16 (widthwise dimension) of the enclosure, and a pair of vertical portions 66 extending downwardly along the side walls 14. The duct horizontal portion 64 communicates with an opening 68 in the roof 18 (FIG. 2) which defines an air outlet for the upper air space 56. The duct vertical portions each communicate with an opening 70 in a respective side wall 14 which defines an air inlet for the lower air space 50.

An air circulating fan 72 is situated in the horizontal portion 64 of the duct directly above the air outlet opening 68 for drawing air from the upper air space 56 and transferring such air to the lower air space 50 (or in reverse direction). The fan is of the double outlet type which is able to divide its outlet flow between the two vertical portions 66 of the duct 62.

It will be appreciated that hot air entering the lower air space 50 is drawn upwardly into the baking chamber 22 through the slots 48 in the floor 46. In order to distribute the air generally uniformly throughout the baking chamber 22, the degree of air permeability of the floor 46 increases progressively in a direction away from the air inlets 70. That is, the air pressure is greatest nearer to the inlets 70 and thus there is a tendency for air to be forced through the nearer or proximate slots at a faster speed than through the remote slots. By making the floor 46 more air permeable in the remote areas, however, the quantity of air flow through the remote slots can be made to approximate that flowing through the proximate slots. Hence, the air temperature within the baking chamber 22 will be more uniform than would otherwise be the case.

The degree of air permeability of the floor regions can be regulated by making the remote slots larger and/or more numerous than the proximate slots. Also, adjustable covers (not shown) can be provided for the slots to afford a greater degree of control over the air permeability characteristics.

In similar fashion, the air permeability of the cover 52 is made progressively greater in the areas remote from the air outlet 68 in order to compensate for the fact that the fan suction is greatest in the areas proximate the fan 72.

Accordingly, the upward air flow within the baking chamber 22 is substantially uniform throughout, and the air paths are generally vertical.

IN OPERATION, products to be baked are passed through the baking chamber 22 upon the conveyor 24. The air within the chamber 22 is heated by the burners 38 situated beneath the conveyor runs. Radiation from the burners may also aid in browning the products traveling on the conveyor run therebeneath. Heated air is drawn upwardly through the air permeable cover 52 and into the upper air space 56 from which it passes through the conduit 62 and enters the lower air space 50. From there, the heated air passes upwardly into the chamber 22 through the air permeable floor 46. This continuous circulation of the heated air increases the uniformity of air temeprature within the chamber.

By increasing the degree of air permeability of the floor in a direction away from the location of maximum air pressure, and by increasing the degree of air permeability of the cover in a direction away from the location of maximum air suction, the air flow through the floor and cover is substantially uniform.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from an upper portion of said baking chamber to a lower portion of said baking chamber, and air circulating means for transferring air through said conduit means from said upper portion of said baking chamber to said lower portion of said baking chamber, to attain a more uniform air temperature within said baking chamber, and a floor beneath a substantial portion of said baking chamber, said conduit means delivering air to a lower air space beneath said floor, said floor being air permeable such that the air travels through said floor and into said baking chamber, the degree of air permeablility of said floor increasing in a direction away from an air inlet where said conduit means delivers air to said lower air space.

2. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, said heating means comprising pairs of gas burners disposed beneath respective runs of said conveyor means, the burners of each pair being parallel relative to one another and non-parallel relative to the travel path of the associated run of said conveyor means, and air distributing means comprising:

conduit means for conducting air from an upper portion of said baking chamber to a lower portion of said baking chamber, and air circulating means for transferring air through said conduit means from said upper portion of said baking chamber to said lower portion of said baking chamber, to attain a more uniform air temperature within said baking chamber,

3. Apparatus according to claim 2 including a floor beneath said baking chamber, said conduit means delivering air to a lower air space beneath said floor, said floor being air permeable such that the air travels through said floor and into said baking chamber.

4. Apparatus according to claim 3, wherein the degree of air permeability of said floor increases in a direction away from an air inlet where said conduit means delivers air to said lower air space.

5. Apparatus according to claim 1 including a cover overlying said baking chamber, said conduit means being arranged to receive air from an upper air space above said cover, said cover being air permeable to permit the upward flow of air therethrough from said baking chamber.

6. Apparatus according to claim 5, wherein the degree of air permeability of said cover increases in a direction away from an air outlet where said duct means receives air from said upper air space.

7. Apparatus according to claim 1, wherein said helical path of said conveyor means defines a lengthwise dimension and a shorter widthwise dimension, said conduit means being disposed intermediate the ends of said lengthwise dimension and extending horizontally along the outside of said enclosure.

8. Apparatus according to claim 7, wherein said conduit means is disposed midway between the ends of said lengthwise dimension.

9. Apparatus according to claim 7, wherein said conduit means includes a horizontal portion extending across a roof of said enclosure, and a pair of vertical portions extending along side walls of said enclosure, said air circulating means comprising a blower disposed midway along said horizontal portion.

10. Apparatus according to claim 1, wherein said heating means comprises pairs of gas burners disposed beneath respective runs of said conveyor means, the burners of each pair being parallel relative to one another and non-parallel relative to the travel path of the associated run of said conveyor means.

11. Apparatus according to claim 10, wherein each said pair of burners is disposed closer to a lower end of the associated conveyor run than to an upper end thereof.

12. A baking oven comprising:

an enclosure, upright partition means disposed within said enclosure for forming an annular baking chamber, a conveyor arranged to travel in an endless spiral path through said baking chamber while carrying a product to be baked, heating means located beneath at least some of the runs of said conveyor for heating the air within said chamber, a floor disposed beneath said baking chamber, said floor being air permeable, a cover disposed across the top of said baking chamber and being air permeable, air distributing means comprising:

conduit means for conducting air from an upper air space above said cover to a lower air space beneath said floor, and air circulating means for circulating air through said conduit means from said upper air space to said lower air space, such that the air enters said baking chamber through said floor and is drawn upwardly through said baking chamber and through said cover for recirculation back to said lower air space, the degree of air permeability of said floor increasing in a direction away from an air inlet where said conduit means delivers air to said lower air space, the degree of air permeability of said cover increasing in a direction away from an air outlet where said conduit means receives air from said upper air space.

13. Apparatus according to claim 12, wherein said helical path of said conveyor means defines a lengthwise dimension and a shorter widthwise dimension, said conduit means being disposed intermediate the ends of said lengthwise dimension and extending horizontally along the outside of said enclosure.

14. Apparatus according to claim 13, wherein said conduit means is disposed midway between the ends of said lengthwise dimension.

15. Apparatus according to claim 13, wherein said conduit means includes a horizontal portion extending across a roof of said enclosure, and a pair of vertical portions extending along side walls of said enclosure, said air circulating means comprising a blower disposed midway along said horizontal portion.

16. Apparatus according to claim 12, wherein said heating means comprises pairs of gas burners disposed beneath respective runs of said conveyor means, the burners of each pair being parallel relative to one another and non-parallel relative to the travel path of the associated run of said conveyor means.

17. Apparatus according to claim 16, wherein each of said pair of burners is disposed closer to a lower end of the associated conveyor run than to an upper end thereof.

18. A method of baking comprising the steps of:

driving a conveyor in a helically endless fashion within a horizontally annular baking chamber while said conveyor carries products to be baked, heating the air within said chamber by means of burners disposed in said chamber beneath at least some of the runs of said conveyor, drawing heated air through an air permeable cover across a substantial portion of the top of said chamber and into an upper air space thereabove, circulating heated air from said upper air space to a lower air space located beneath said chamber and from said lower air space into said chamber thorugh an air permeable floor disposed across a substantial portion of the bottom of said chamber, creating a uniform air flow through said cover by increasing the degree of air permeability thereof in a direction away from an air outlet where air leaves said upper air space, and creating a uniform air flow through said floor by increasing the degree of air permeability thereof in a direction away from an air inlet where air enters said lower air space.

19. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from an upper portion of said baking chamber to a lower portion of said baking chamber, and air circulating means for transferring air through said conduit means from said upper portion of said baking chamber to said lower portion of said baking chamber, to attain a more uniform air temperature within said baking chamber, a floor beneath a substantial portion of said baking chamber, said conduit means delivering air to a lower air space beneath said floor, said floor being air permeable such that the air travels through said floor and into said baking chamber, and a cover overlying a substantial portion of said baking chamber, said conduit means being arranged to receive air from an upper air space above said cover, said cover being air permeable to permit the upward flow of air therethrough from said baking chamber.

20. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from an upper portion of said baking chamber to a lower portion of said baking chamber, and air circulating means for transferring air through said conduit means from said upper portion of said baking chamber to said lower portion of said baking chamber, to attain a more uniform air temperature within said baking chamber, and a cover overlying a substantial portion of said baking chamber, said conduit means being arranged to receive air from an upper air space above said cover, said cover being air permeable to permit the upward flow of air therethrough from said baking chamber, the degree of air permeability of said cover increasing in a direction away from an air outlet where said conduit means receives air from said upper air space.

21. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, and air distributing means comprising:

conduit means for conducting air from an upper portion of said baking chamber to a lower portion of said baking chamber, and air circulating means for transferring air through said conduit means from said upper portion of said baking chamber to said lower portion of said baking chamber, to attain a more uniform air temperature within said baking chamber, said helical path of said conveyor means defining a lengthwise dimension and a shorter widthwise dimension, said conduit means being disposed intermediate the ends of said lengthwise dimension and extending horizontally along the outside of said enclosure.

22. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from a lower portion of said baking chamber to an upper portion of said baking chamber, and air circulating means for transferring air through said conduit means from said lower portion of said baking chamber to said upper portion of said baking chamber, to attain a more uniform air temperature within said baking chamber, and a floor beneath a substantial portion of said baking chamber, said conduit means receiving air from a lower air space beneath said floor, said floor being air permeable such that the air travels through said floor and into said conduit means, the degree of air permeability of said floor increasing in a direction away from an air outlet where said conduit means receives air from said lower air space.

23. A baking oven comprising:

an enclosure, upright partition means disposed within said enclosure for forming an annular baking chamber, a conveyor arranged to travel in an endless spiral path through said baking chamber while carrying a product to be baked, heating means located beneath at least some of the runs of said conveyor for heating the air within said chamber, a floor disposed beneath a substantial portion of said baking chamber, said floor being air permeable, a cover disposed across a substantial portion of the top of said baking chamber and being air permeable, air distributing means comprising:

conduit means for conducting air to an upper air space above said cover from a lower air space beneath said floor, and air circulating means for circulating air through said conduit means to said upper air space from said lower air space, such that the air enters said baking chamber through said cover and is drawn downwardly through said baking chamber and through said floor for recirculation back to said upper air space, the degree of air permeability of said cover increasing in a direction away from an air inlet where said conduit means delivers air to said upper air space, the degree of air permeability of said floor increasing in a direction away from an air outlet where said conduit means receives air from said lower air space.

24. A method of baking comprising the steps of:

driving a conveyor in a helically endless fashion within a horizontally annular baking chamber while said conveyor carries products to be baked, heating the air within said chamber by means of burners disposed in said chamber beneath at least some of the runs of said conveyor, drawing heated air through an air permeable floor across a substantial portion of the bottom of said chamber and into a lower air space therebelow, circulating heated air from said lower air space to an upper air space located above said chamber and from said upper air space into said chamber through an air permeable cover disposed across a substantial portion of the top of said chamber, creating a uniform air flow through said cover by increasing the degree of air permeability thereof in a direction away from an air inlet where air enters said upper air space, and creating a uniform air flow through said floor by increasing the degree of air permeability thereof in a direction away from an air outlet where air leaves said lower air space.

25. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from a lower portion of said baking chamber to an upper portion of said baking chamber, and air circulating means for transferring air through said conduit means from said lower portion of said baking chamber to said upper portion of said baking chamber, to attain a more uniform air temperature within said baking chamber, a floor beneath a substantial portion of said baking chamber, said conduit means receiving air from a lower air space beneath said floor, said floor being air permeable such that the air travels through said floor and into said lower air space, and a cover overlying a substantial portion of said baking chamber, said conduit means being arranged to introduce air into an upper air space above said cover, said cover being air permeable to permit the downward flow of air therethrough into said baking chamber.

26. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from a lower portion of said baking chamber to an upper portion of said baking chamber, and air circulating means for transferring air through said conduit means from said lower portion of said baking chamber to said upper portion of said baking chamber, to attain a more uniform air temperature within said baking chamber, and a cover overlying a substantial portion of said baking chamber, said conduit means being arranged to introduce air into an upper air space above said cover, said cover being air permeable to permit a downward flow of air therethrough into said baking chamber, the degree of air permeability of said cover increasing in a direction away from an air inlet where said conduit means introduces air into said upper air space.

27. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, air distributing means comprising:

conduit means for conducting air from a lower portion of said baking chamber to an upper portion of said baking chamber, and air circulating means for transferring air through said conduit means from said lower portion of said baking chamber to said upper portion of said baking chamber, to attain a more uniform air temperature within said baking chamber, said helical path of said conveyor means defining a lengthwise dimension and a shorter widthwise dimension, said conduit means being disposed intermediate the ends of said lengthwise dimension and extending horizontally along the outside of said enclosure.

28. A baking oven comprising:

an enclosure containing therein a horizontally annular baking chamber, conveyor means arranged to travel in an endless helical path through said baking chamber while carrying a product to be baked, heating means located beneath at least some of the runs of said conveyor means for heating the air within said baking chamber, said heating means comprising pairs of gas burners disposed beneath respective runs of said conveyor means, the burners of each pair being parallel relative to one another and non-parallel relative to the travel path of the associated run of said conveyor means, and air distributing means comprising:

conduit means for conducting air from a lower portion of said baking chamber to an upper portion of said baking chamber, and air circulating means for transferring air through said conduit means from said lower portion of said baking chamber to said upper portion of said baking chamber, to attain a more uniform air temperature within said baking chamber.

* * * * *